US007258176B2

(12) United States Patent
Tibbitts et al.

(10) Patent No.: US 7,258,176 B2
(45) Date of Patent: Aug. 21, 2007

(54) DRILL BIT

(75) Inventors: Gordon A. Tibbitts, Murray, UT (US); Paul O. Padgett, Cody, WY (US); Harry B. Curlett, Cody, WY (US); Samuel R. Curlett, Powell, WY (US); Nathan J. Harder, Powell, WY (US)

(73) Assignee: Particle Drilling, Inc., Houston, TX (US)

( * ) Notice: Subject to any disclaimer, the term of this patent is extended or adjusted under 35 U.S.C. 154(b) by 0 days.

(21) Appl. No.: 10/825,338

(22) Filed: Apr. 15, 2004

(65) Prior Publication Data

US 2006/0027398 A1 Feb. 9, 2006

Related U.S. Application Data

(60) Provisional application No. 60/463,903, filed on Apr. 16, 2003.

(51) Int. Cl.
*E21B 7/16* (2006.01)

(52) U.S. Cl. ..... 175/65; 175/67; 175/424

(58) Field of Classification Search ..... None
See application file for complete search history.

(56) References Cited

U.S. PATENT DOCUMENTS

| | | | | |
|---|---|---|---|---|
| 3,112,800 | A | 12/1963 | Bobo | |
| 3,385,386 | A | 5/1968 | Goodwin et al. | 175/422 |
| 3,389,759 | A | 6/1968 | Mori et al. | 175/258 |
| 3,416,614 | A | 12/1968 | Goodwin et al. | |
| 3,542,142 | A | 11/1970 | Hasiba et al. | 175/67 |
| 3,548,959 | A | 12/1970 | Hasiba | 175/393 |
| 3,576,221 | A | 4/1971 | Hasiba | |
| 3,704,966 | A | 12/1972 | Beck, Jr. | |
| 3,852,200 | A | 12/1974 | Meyer | |
| 3,865,202 | A | 2/1975 | Takahashi et al. | |
| 3,924,698 | A | 12/1975 | Juvkam-Wold | |
| 4,042,048 | A | 8/1977 | Schwabe | |
| 4,141,592 | A | 2/1979 | Lavon | |
| 4,391,339 | A | 7/1983 | Johnson, Jr. et al. | |
| 4,534,427 | A | 8/1985 | Wang et al. | |
| 4,624,327 | A | 11/1986 | Reichman | |
| 4,768,709 | A | 9/1988 | Yie | |
| 4,825,963 | A | 5/1989 | Ruhle | |

(Continued)

FOREIGN PATENT DOCUMENTS

GB 2385346 A 8/2003

(Continued)

OTHER PUBLICATIONS

Cohen et al., "High-Pressure Jet Kerf Drilling Shows Significant Potential to Increase ROP," SPE 96557, Oct. 2003, 1-8.

(Continued)

*Primary Examiner*—Frank Tsay
(74) *Attorney, Agent, or Firm*—King & Spalding LLP

(57) ABSTRACT

A drill bit for drilling a well bore using solid material impactors comprising a nozzle and a cavity for accelerating the velocity of the solid material impactors and directing flow of the solid material impactors through the nozzle. The drill bit may also comprise a junk slot for return flow of the drilling fluid and solid material impactors.

11 Claims, 8 Drawing Sheets

U.S. PATENT DOCUMENTS

| | | | |
|---|---|---|---|
| 5,199,512 | A | 4/1993 | Curlett |
| 5,291,957 | A | 3/1994 | Curlett |
| 5,355,967 | A | 10/1994 | Mueller et al. |
| 5,542,486 | A | 8/1996 | Curlett |
| 5,862,871 | A | 1/1999 | Curlett |
| 5,944,123 | A | 8/1999 | Johnson |
| 6,142,248 | A | 11/2000 | Thigpen et al. |
| 6,347,675 | B1 | 2/2002 | Kollé |
| 6,386,300 | B1 | 5/2002 | Curlett et al. |
| 6,571,700 | B2 | 6/2003 | Nakamura et al. |
| 6,581,700 | B2 | 6/2003 | Curlett et al. |
| 2006/0011386 | A1 | 1/2006 | Tibbitts |
| 2006/0016622 | A1 | 1/2006 | Tibbitts |
| 2006/0016624 | A1 | 1/2006 | Tibbitts |
| 2006/0021798 | A1 | 2/2006 | Tibbitts |
| 2006/0027398 | A1 | 2/2006 | Tibbitts et al. |

FOREIGN PATENT DOCUMENTS

| | | | |
|---|---|---|---|
| GB | 2385346 | B | 9/2004 |
| WO | WO 2002/25053 | A1 | 3/2002 |
| WO | WO 2004/094734 | A2 | 11/2004 |
| WO | WO 2004/106693 | | 12/2004 |

OTHER PUBLICATIONS

Galecki et al., "Steel Shot Entrained Ultra High Pressure Waterjet For Cutting and Drilling in Hard Rocks," 371-388.
Co-pending U.S. Appl. No. 10/558,181, filed Nov. 22, 2005, Titled "System for Cutting Earthen Formations".
Co-pending U.S. Appl. No. 10/897,196, filed Jul. 22, 2004, Titled "Impact Excavation System and Method".
Co-pending U.S. Appl. No. 11/204,436, filed Aug. 16, 2005, Titled "Internal Subs with Flow Control of Shot".
Co-pending U.S. Appl. No. 11/204,442, filed Aug. 16, 2005, Titled "Impact Excavation System and Method with Particle Trap".
Co-pending U.S. Appl. No. 11/204,722, filed Aug. 16, 2005, Titled "Shot Trap".
Co-pending U.S. Appl. No. 11/204,862, filed Aug. 16, 2005, Titled "PID Nozzles".
Co-pending U.S. Appl. No. 11/204,981, filed Aug. 16, 2005, Titled "Injector Systems".
Co-pending U.S. Appl. No. 11/205/006, filed Aug. 16, 2005, Titled "Secondary Types of Educators".
International Search Report PCT/US04/11578; Dated Dec. 28, 2004.
International Preliminary Report of Patentability PCT/US04/11578; Dated Oct. 21, 2005.
Written Opinion PCT/US04/11578; Dated Dec. 28, 2004.
William C. Mauer et al.; "Impact Crater Formation in Rock"; Journal of Applied Physics; Jul. 1960; pp. 1247-1252; vol. 31, No. 7.
L. W. Ledgerwood, Jr.; "Efforts to Develop Improved Oilwell Drilling Methods"; Petroleum Transactions; 1960; pp. 61-74; vol. 219; AIME.
J. E. Eckel et al.; "Development and Testing of Jet Pump Pellet Impact Drill Bits"; Petroleum Transactions; 1956; pp. 1-10; vol. 207; AIME.
David A. Summers; "Waterjetting Technology"; Feb. 9, 1995; pp. 557-598; Taylor & Francis.
Arthur Andersen; "Global E&P Trends"; Jul. 1999; p. 13.
Mike Killalea; "High Pressure Drilling System Triples ROPS, Stymies Bit Wear"; Drilling, Mar./Apr. 1989; pp. 10 and 12.
Security DBS Booklet; 1995.
S. D. Veenhuizen et al.; "Ultra-High Pressure Jet Assist of Mechanical Drilling"; 1997 SPE/IADC Drilling Conference; Mar. 4-6, 1997; pp. 79-90; SPE/IADC 37579; SPE/IADC Drilling Conference; Amsterdam, The Netherlands.
Carl R. Peterson et al.; "A New Look at Bit Flushing or the Importance of the Crushed Zone in Rock Drilling and Cutting"; undated.
"A Review of Mechanical Bit/Rock Interactions"; undated; pp. 3-1 to 3-68.
William C. Maurer; "Advanced Drilling Techniques"; 1980; Petroleum Publishing Co.; Tulsa, Oklahoma, USA.
Madan M. Singh; "Rock Breakage By Pellet Impact"; Dec. 24, 1969; IITRI Project No. D6000; ITT Research Institute; USA.
John F. Ripken et al.; "A Study of The Fragmentation of Rock by Impingement With Water and Solid Impactors"; Feb. 1972; Project Report No. 131; University of Minnesota; Minneapolis, Minnesota, USA.
John C. Fair; "Development of High-Pressure Abrasive-Jet Drilling"; Journal of Petroleum Technology; Aug. 1981; pp. 1379-1388; Society of Petroleum Engineers; USA.
William C. Maurer et al.; "Deep Drilling Basic Research; vol. 1—Summary Report"; Jun. 1990; GRI 90/0265.1; Gas Research Institute; USA.
D. A. Summers et al.; "A Further Investigation of DIAjet Cutting"; Jet Cutting Technology-Proceedings of the 10th International Conference; 1991; pp. 181-192; Elsievier Science Publishers Ltd.; USA.
J. J. Kolle et al.; "Laboratory and Field Testing of an Ultra-High Pressure, Jet-Assisted Drilling System"; 1991 SPE/IADC Drilling Conference; Mar. 11-14, 1991; pp. 847-856; SPE/IADC 22000; SPE/IADC Drilling Conference; Amsterdam, The Netherlands.
*Curlett Family Limited Partnership, Ltd., Plaintiff* V. *Particle Drilling Technologies, Inc., a Delaware Corporation; and Particle Drilling Technologies, Inc. a Nevada Corporation Defendant*; Civil Action No. 4:06-CV-01012; Affidavit of Harry (Hal) B. Curlett, May 3, 2006.
Eckel et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling," Journal of Petroleum Technology, Aug. 1981, 1379-1388.
Geddes et al., "Leveraging a New Energy Source to Enhance Heavy-Oil and Oil-Sands Production," Society of Petroleum Engineers, SPE/PS-CIM/CHOA 97781, 2005.
Kolle et al., "Laboratory and Field Testing of an Ultra-High-Pressure, Jet-Assisted Drilling System," SPE/IADC 22000, 1991, 847-856.
Ledgerwood, L., "Efforts to Devlop Improved Oilwell Drilling Methods," Petroleum Transactions, Aime, 1960, 61-74, vol. 219.
Maurer, et al., "Deep Drilling Basic Research Final Report", Jun. 1990.
Maurer, William, "Impact Crater Formation in Rock," Journal of Applied Physics, Jul. 1960, 1247-1252, vol. 31, No. 7.
Summers et al., "A Further Investigation of DIAjet Cutting," Jet Cutting Technology-Proceedings of the 10th International Conference, 1991, pp. 181-192; Elsevier Science Publishers Ltd, USA.
www.particledrilling.com, May 4, 2006.
Summers, David A., "Waterjet Drilling Systems," from *Waterjetting Technology*, pp. 582-583, Published by E&FN Spon, London, UK, First Edition 1995 (ISBN 0 419 19660 9).

DRILL BIT

CROSS-REFERENCE TO RELATED APPLICATIONS

The present application claims the benefit of 35 U.S.C. 111(b) provisional application Ser. No. 60/463,903 filed Apr. 16, 2003 and entitled Drill Bit.

STATEMENT REGARDING FEDERALLY SPONSORED RESEARCH OR DEVELOPMENT

Not Applicable.

BACKGROUND

There are many variables to consider to ensure a usable well bore is constructed when using cutting systems and processes for the drilling of well bores or the cutting of formations for the construction of tunnels and other subterranean earthen excavations. Many variables, such as formation hardness, abrasiveness, pore pressures, and formation elastic properties affect the effectiveness of a particular drill bit in drilling a well bore. Additionally, in drilling well bores, formation hardness and a corresponding degree of drilling difficulty may increase exponentially as a function of increasing depth. The rate at which a drill bit may penetrate the formation typically decreases with harder and tougher formation materials and formation depth.

When the formation is relatively soft, as with shale, material removed by the drill bit will have a tendency to reconstitute onto the teeth of the drill bit. Build-up of the reconstituted formation on the drill bit is typically referred to as "bit balling" and reduces the depth that the teeth of the drill bit will penetrate the bottom surface of the well bore, thereby reducing the efficiency of the drill bit. Particles of a shale formation also tend to reconstitute back onto the bottom surface of the bore hole. The reconstitution of a formation back onto the bottom surface of the bore hole is typically referred to as "bottom balling". Bottom balling prevents the teeth of a drill bit from engaging virgin formation and spreads the impact of a tooth over a wider area, thereby also reducing the efficiency of a drill bit. Additionally, higher density drilling muds that are required to maintain well bore stability or well bore pressure control exacerbate bit balling and the bottom balling problems.

When the drill bit engages a formation of a harder rock, the teeth of the drill bit press against the formation and densify a small area under the teeth to cause a crack in the formation. When the porosity of the formation is collapsed, or densified, in a hard rock formation below a tooth, conventional drill bit nozzles ejecting drilling fluid are used to remove the crushed material from below the drill bit. As a result, a cushion, or densification pad, of densified material is left on the bottom surface by the prior art drill bits. If the densification pad is left on the bottom surface, force by a tooth of the drill bit will be distributed over a larger area and reduce the effectiveness of a drill bit.

There are generally two main categories of modern drill bits that have evolved over time. These are the commonly known fixed cutter drill bit and the roller cone drill bit. Additional categories of drilling include percussion drilling and mud hammers. However, these methods are not as widely used as the fixed cutter and roller cone drill bits. Within these two primary categories (fixed cutter and roller cone), there are a wide variety of variations, with each variation designed to drill a formation having a general range of formation properties.

The fixed cutter drill bit and the roller cone type drill bit generally constitute the bulk of the drill bits employed to drill oil and gas wells around the world. When a typical roller cone rock bit tooth presses upon a very hard, dense, deep formation, the tooth point may only penetrate into the rock a very small distance, while also at least partially, plastically "working" the rock surface. Under conventional drilling techniques, such working the rock surface may result in the densification as noted above in hard rock formations.

With roller cone type drilling bits, a relationship exists between the number of teeth that impact upon the formation and the drilling RPM of the drill bit. A description of this relationship and an approach to improved drilling technology is set forth and described in U.S. Pat. No. 6,386,300 issued May 14, 2002, incorporated herein by reference for all purposes. The '300 patent discloses the use of solid material impactors introduced into drilling fluid and pumped though a drill string and drill bit to contact the rock formation ahead of the drill bit. The kinetic energy of the impactors leaving the drill bit is given by the following equation: $E_k = \frac{1}{2}\,\text{Mass}(\text{Velocity})^2$. The mass and/or velocity of the impactors may be chosen to satisfy the mass-velocity relationship in order to structurally alter the rock formation.

BRIEF DESCRIPTION OF THE DRAWINGS

For a more complete understanding of the present invention, reference is made to the following description taken in conjunction with the accompanying drawings in which.

DETAILED DESCRIPTION OF THE EMBODIMENTS

Figure 1:
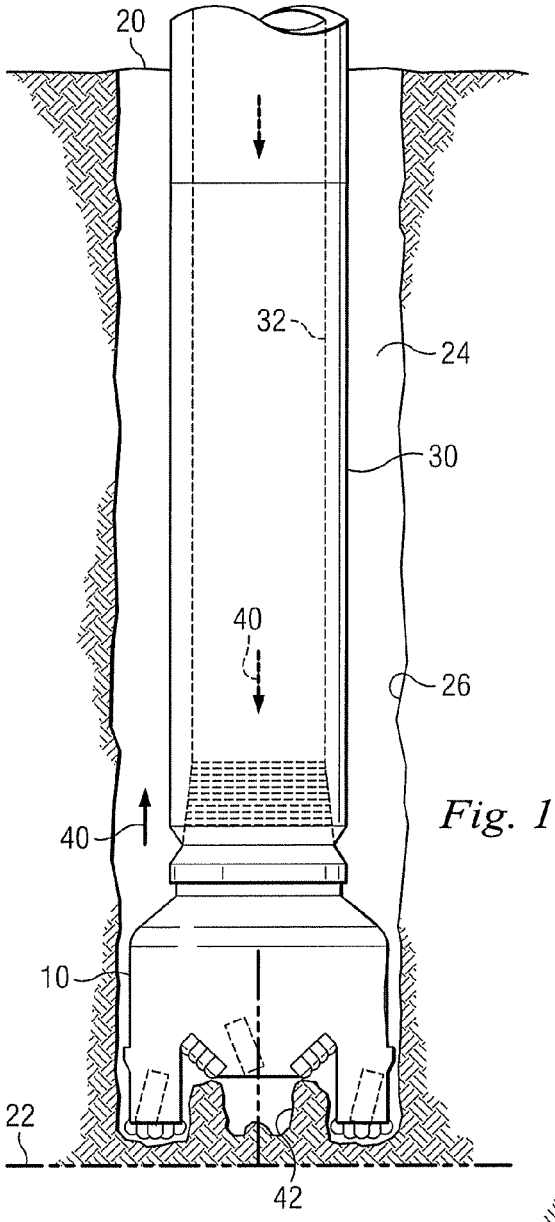
FIG. 1 is a side elevational view of a drilling system utilizing a first embodiment of a drill bit.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

FIG. 1 shows a first embodiment of a drill bit 10 at the bottom of a well bore 20 and attached to a drill string 30. The drill bit 10 acts upon a bottom surface 22 of the well bore 20. The drill string 30 has a central passage 32 that supplies drilling fluids 40 to the drill bit 10. The drill bit 10 uses the drilling fluids 40 and solid material impactors when acting upon the bottom surface 22 of the well bore 20. The solid material impactors reduce bit balling and bottom balling by contacting the bottom surface 22 of the well bore 20 with the solid material impactors. The solid material impactors may be used for any type of contacting of the bottom surface 22 of the well bore 20, whether it be abrasion-type drilling, impact-type drilling, or any other drilling using solid material impactors. The drilling fluids 40 that have been used by the drill bit 10 on the bottom surface 22 of the well bore 20 exit the well bore 20 through a well bore annulus 24 between the drill string 30 and the inner wall 26 of the well bore 20. Particles of the bottom surface 22 removed by the drill bit 10 exit the well bore 20 with the drill fluid 40 through the well bore annulus 24. The drill bit 10 creates a rock ring 42 at the bottom surface 22 of the well bore 20.

Figure 2:
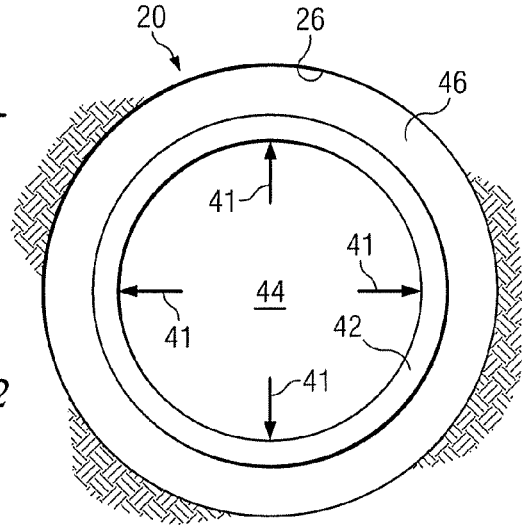
FIG. 2 is a top plan view of the bottom surface of a well bore formed by the drill bit of FIG. 1.

Referring now to FIG. 2, a top view of the rock ring 42 formed by the drill bit 10 is illustrated. An interior cavity 44 is worn away by an interior portion of the drill bit 10 and the exterior cavity 46 and inner wall 26 of the well bore 20 are worn away by an exterior portion of the drill bit 10. The rock ring 42 possesses hoop strength, which holds the rock ring 42 together and resists breakage. The hoop strength of the rock ring 42 is typically much less than the strength of the bottom surface 22 or the inner wall 26 of the well bore 20, thereby making the drilling of the bottom surface 22 less demanding on the drill bit 10. By applying a compressive load and a side load, shown with arrows 41, on the rock ring 42, the drill bit 10 causes the rock ring 42 to fracture. The drilling fluid 40 then washes the residual pieces of the rock ring 42 back up to the surface through the well bore annulus 24.

Remaining with FIG. 2, mechanical cutters, utilized on many of the surfaces of the drill bit 10, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 3:
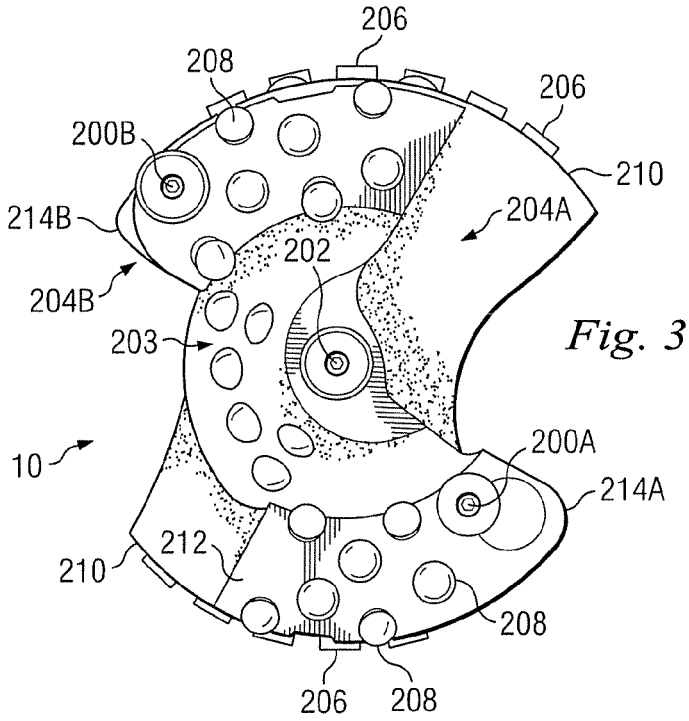
FIG. 3 is an end elevational view of the drill bit of FIG. 1.

Referring now to FIG. 3, an end elevational view of the drill bit 10 of FIG. 1 is illustrated. The drill bit 10 comprises two side nozzles 200A, 200B and a center nozzle 202. The side and center nozzles 200A, 200B, 202 discharge drilling fluid and solid material impactors (not shown) into the rock formation or other surface being excavated. The solid material impactors may comprise steel shot ranging in diameter from about 0.010 to about 0.500 of an inch. However, various diameters and materials such as ceramics, etc. may be utilized in combination with the drill bit 10. The solid material impactors contact the bottom surface 22 of the well bore 20 and are circulated through the annulus 24 to the surface. The solid material impactors may also make up any suitable percentage of the drill fluid for drilling through a particular formation.

Still referring to FIG. 3, the center nozzle 202 is located in a center portion 203 of the drill bit 10. The center nozzle 202 may be angled to the longitudinal axis of the drill bit 10 to create an interior cavity 44 and also cause the rebounding solid material impactors to flow into the major junk slot 204A. The side nozzle 200A located on a side arm 214A of the drill bit 10 may also be oriented to allow the solid material impactors to contact the bottom surface 22 of the well bore 20 and then rebound into the major junk slot 204A. The second side nozzle 200B is located on a second side arm 214B. The second side nozzle 200B may be oriented to allow the solid material impactors to contact the bottom surface 22 of the well bore 20 and then rebound into a minor junk slot 204B. The orientation of the side nozzles 200A, 200B may be used to facilitate the drilling of the large exterior cavity 46. The side nozzles 200A, 200B may be oriented to cut different portions of the bottom surface 22. For example, the side nozzle 200B may be angled to cut the outer portion of the exterior cavity 46 and the side nozzle 200A may be angled to cut the inner portion of the exterior cavity 46. The major and minor junk slots 204A, 204B allow the solid material impactors, cuttings, and drilling fluid 40 to flow up through the well bore annulus 24 back to the surface. The major and minor junk slots 204A, 204B are oriented to allow the solid material impactors and cuttings to freely flow from the bottom surface 22 to the annulus 24.

As described earlier, the drill bit 10 may also comprise mechanical cutters and gauge cutters. Various mechanical cutters are shown along the surface of the drill bit 10. Hemispherical PDC cutters are interspersed along the bottom face and the side walls 210 of the drill bit 10. These hemispherical cutters along the bottom face break down the large portions of the rock ring 42 and also abrade the bottom surface 22 of the well bore 20. Another type of mechanical cutter along the side arms 214A, 214B are gauge cutters 230. The gauge cutters 230 form the final diameter of the well bore 20. The gauge cutters 230 trim a small portion of the well bore 20 not removed by other means. Gauge bearing surfaces 206 are interspersed throughout the side walls 210 of the drill bit 10. The gauge bearing surfaces 206 ride in the well bore 20 already trimmed by the gauge cutters 230. The gauge bearing surfaces 206 may also stabilize the drill bit 10 within the well bore 20 and aid in preventing vibration.

Still referring to FIG. 3, the center portion 203 comprises a breaker surface, located near the center nozzle 202, comprising mechanical cutters 208 for loading the rock ring 42. The mechanical cutters 208 abrade and deliver load to the lower stress rock ring 42. The mechanical cutters 208 may comprise PDC cutters, or any other suitable mechanical cutters. The breaker surface is a conical surface that creates the compressive and side loads for fracturing the rock ring 42. The breaker surface and the mechanical cutters 208 apply force against the inner boundary of the rock ring 42 and fracture the rock ring 42. Once fractured, the pieces of the rock ring 42 are circulated to the surface through the major and minor junk slots 204A, 204B.

Figure 4:
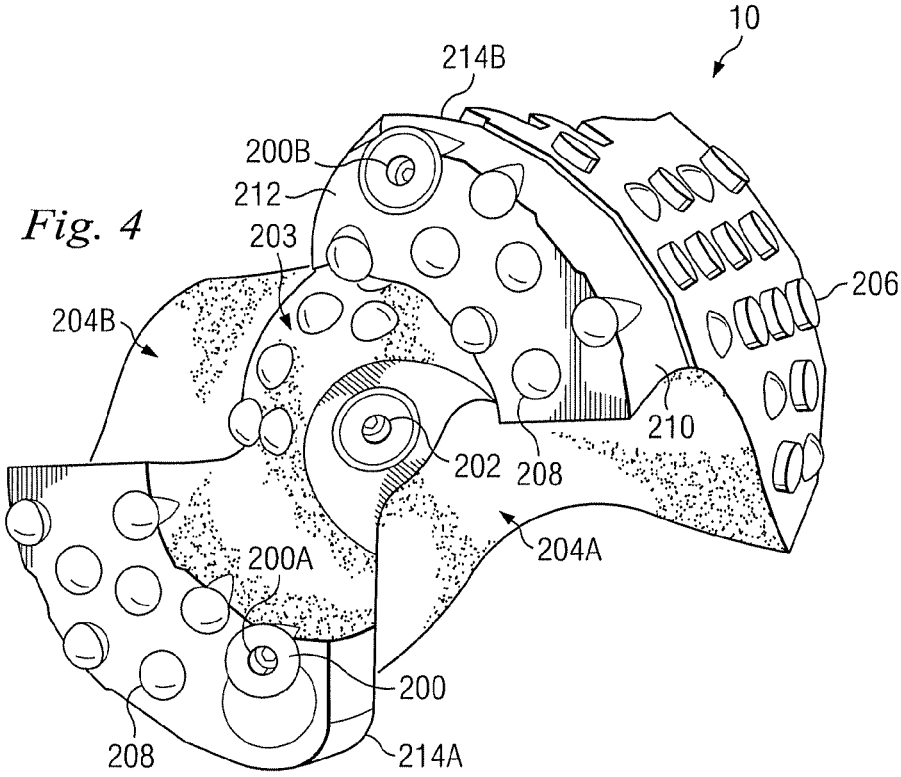
FIG. 4 is an enlarged end elevational view of the drill bit of FIG. 3.

Referring now to FIG. 4, an enlarged end elevational view of the drill bit 10 is shown. As shown more clearly in FIG. 4, the gauge bearing surfaces 206 and mechanical cutters 208 are interspersed on the outer side walls 210 of the drill bit 10. The mechanical cutters 208 along the side walls 210 may also aid in the process of creating drill bit 10 stability and also may perform the function of the gauge bearing surfaces 206 if they fail. The mechanical cutters 208 are oriented in various directions to reduce the wear of the gauge bearing surface 206 and also maintain the correct well bore 20 diameter. As noted with the mechanical cutters 208 of the breaker surface, the solid material impactors fracture the bottom surface 22 of the well bore 20 and, as such, the mechanical cutters 208 remove remaining ridges of rock and assist in the cutting of the bottom hole. However, the drill bit 10 need not necessarily comprise the mechanical cutters 208 on the side wall 210 of the drill bit 10.

Figure 5:
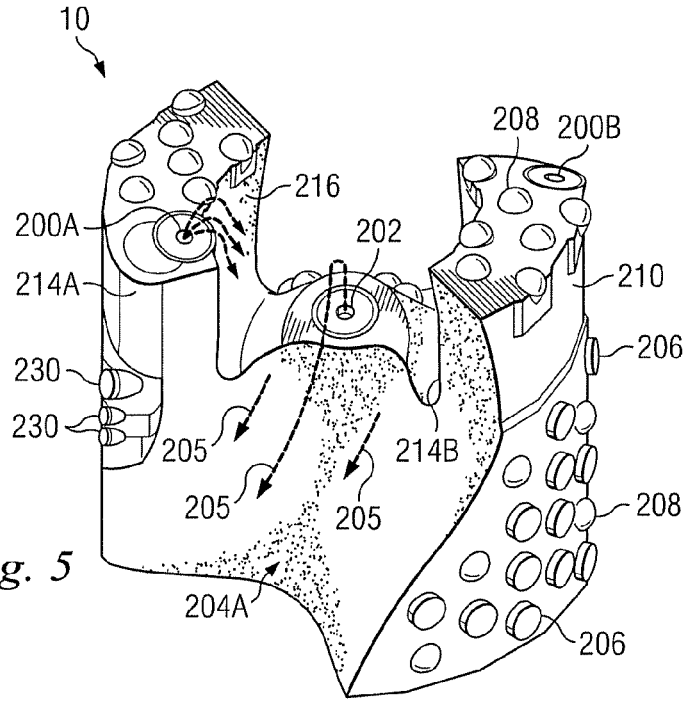
FIG. 5 is a perspective view of the drill bit of FIG. 1.

Referring now to FIG. 5, a side elevational view of the drill bit 10 is illustrated. FIG. 5 shows the gauge cutters 230 included along the side arms 214A, 214B of the drill bit 10. The gauge cutters 230 are oriented so that a cutting face of the gauge cutter 230 contacts the inner wall 26 of the well bore 20. The gauge cutters 230 may contact the inner wall 26 of the well bore at any suitable backrake, for example a backrake of 15° to 45°. Typically, the outer edge of the cutting face scrapes along the inner wall 26 to refine the diameter of the well bore 20.

Still referring to FIG. 5, one side nozzle 200A is disposed on an interior portion of the side arm 214A and the second side nozzle 200B is disposed on an exterior portion of the opposite side arm 214B. Although the side nozzles 200A, 200B are shown located on separate side arms 214A, 214B of the drill bit 10, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the exterior cavity 46 formed by the side nozzles 200A, 200B and the mechanical cutters 208 on the face 212 of each side arm 214A, 214B. The solid material impactors from one side nozzle 200A rebound from the rock formation and combine with the drilling fluid and cuttings flow to the major junk slot 204A and up to the annulus 24. The flow of the solid material impactors, shown by arrows 205, from the center nozzle 202 also rebound from the rock formation up through the major junk slot 204A.

Figure 6:
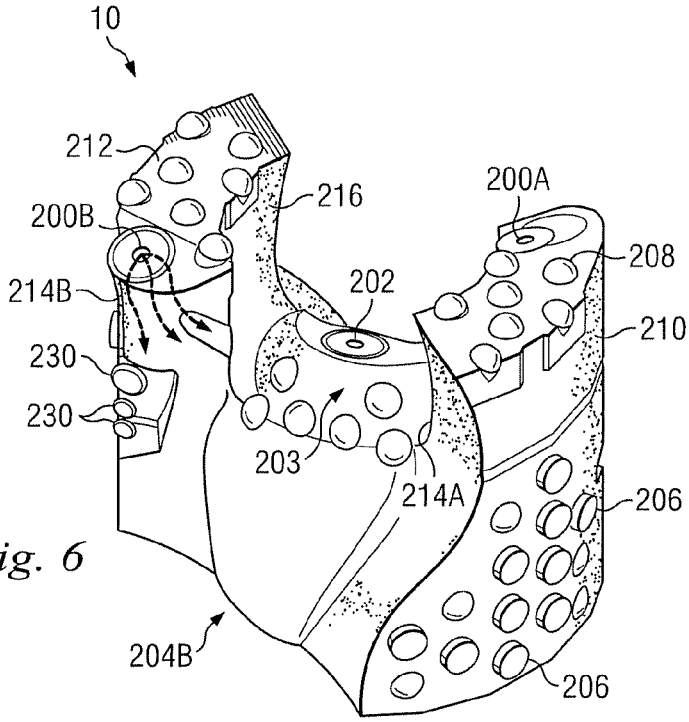
FIG. 6 is a perspective view of the drill bit of FIG. 1 illustrating a breaker and junk slot of a drill bit.
Figure 7:
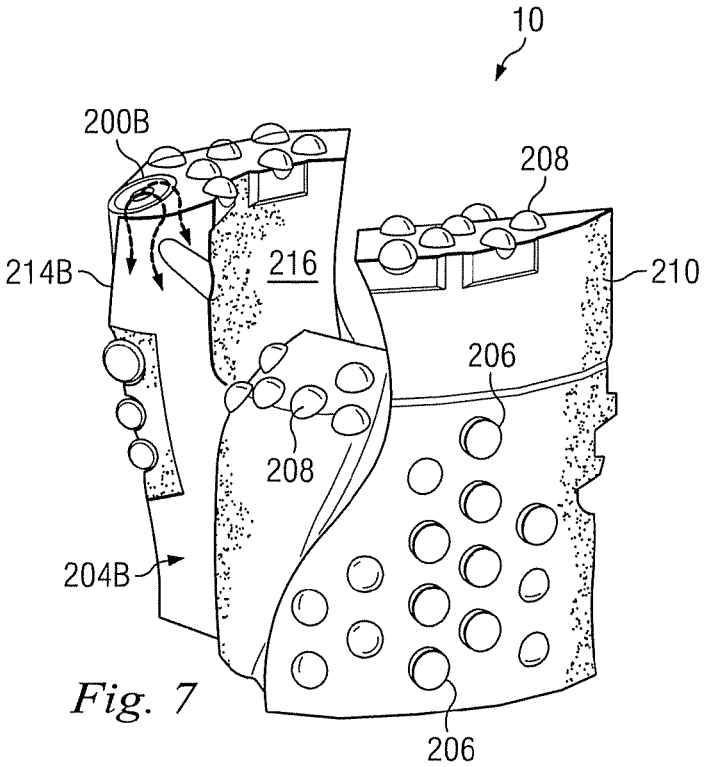
FIG. 7 is a side elevational view of the drill bit of FIG. 1 illustrating a flow of solid material impactors.

Referring now to FIGS. 6 and 7, the minor junk slot 204B, breaker surface, and the second side nozzle 200B are shown in greater detail. The breaker surface is conically shaped, tapering to the center nozzle 202. The second side nozzle 200B is oriented at an angle to allow the outer portion of the exterior cavity 46 to be contacted with solid material impactors. The solid material impactors then rebound up through the minor junk slot 204B, shown by arrows 205, along with any cuttings and drilling fluid 40 associated therewith.

Figure 8:
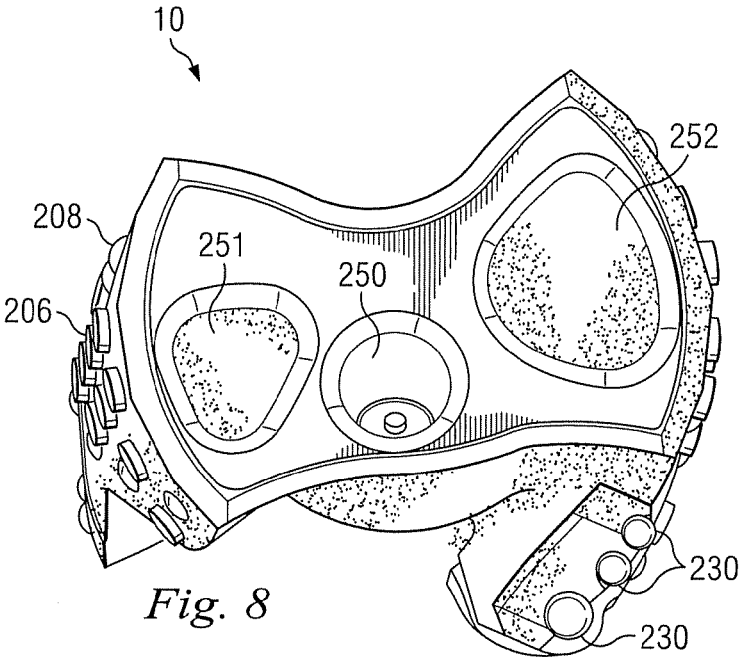
FIG. 8 is a top elevational view of the drill bit of FIG. 1 illustrating side and center cavities.
Figure 9:
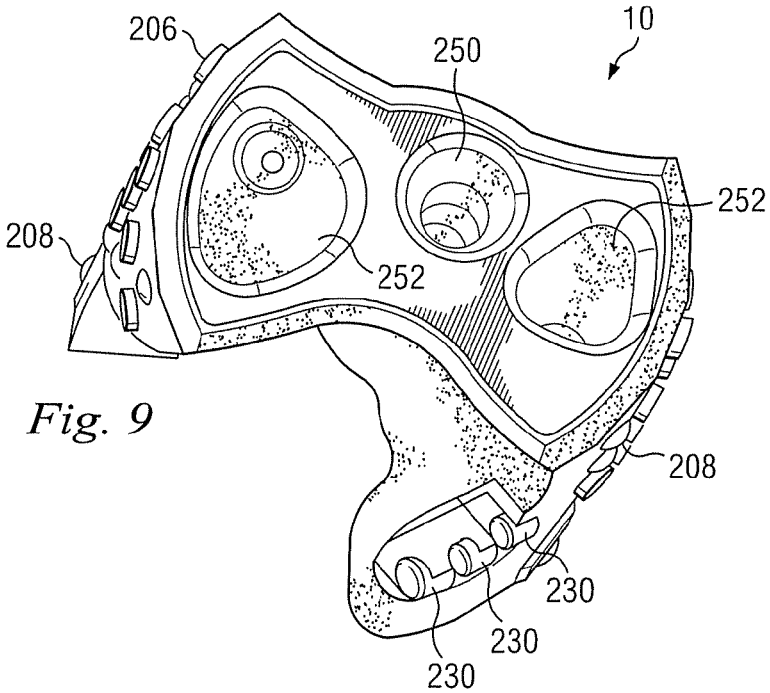
FIG. 9 is a canted top elevational view of the drill bit of FIG. 8.

Referring now to FIGS. 8 and 9, top elevational views of the drill bit 10 are shown. Each nozzle 200A, 200B, 202 receives drilling fluid 40 and solid material impactors from a common plenum feeding separate cavities 250, 251, and 252. The center cavity 250 feeds drilling fluid 40 and solid material impactors to the center nozzle 202 for contact with the rock formation. The side cavities 251, 252 are formed in the interior of the side arms 214A, 214B of the drill bit 10, respectively. The side cavities 251, 252 provide drilling fluid 40 and solid material impactors to the side nozzles 200A, 200B for contact with the rock formation. By utilizing separate cavities 250, 251,252 for each nozzle 202, 200A, 200B, the percentages of solid material impactors in the drilling fluid 40 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202. However, in alternate embodiments, other arrangements of the cavities 250, 251, 252, or the utilization of a single cavity, are possible.

Figure 10:
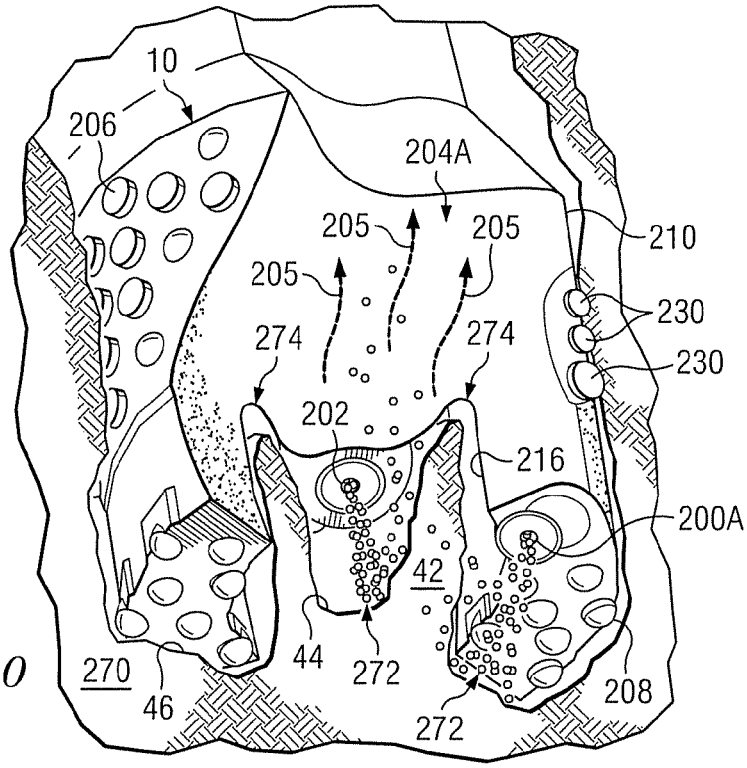
FIG. 10 is a cutaway view of the drill bit of FIG. 1 engaged in a well bore.

Referring now to FIG. 10, the drill bit 10 in engagement with the rock formation 270 is shown. As previously discussed, the solid material impactors 272 flow from the nozzles 200A, 200B, 202 and make contact with the rock formation 270 to create the rock ring 42 between the side arms 214A, 214B of the drill bit 10 and the center nozzle 202 of the drill bit 10. The solid material impactors 272 from the center nozzle 202 create the interior cavity 44 while the side nozzles 200A, 200B create the exterior cavity 46 to form the outer boundary of the rock ring 42. The gauge cutters 230 refine the more crude well bore 20 cut by the solid material impactors 272 into a well bore 20 with a more smooth inner wall 26 of the correct diameter.

Still referring to FIG. 10, the solid material impactors 272 flow from the first side nozzle 200A between the outer surface of the rock ring 42 and the interior wall 216 in order to move up through the major junk slot 204A to the surface. The second side nozzle 200B (not shown) emits solid material impactors 272 that rebound toward the outer surface of the rock ring 42 and to the minor junk slot 204B (not shown). The solid material impactors 272 from the side nozzles 200A, 200B may contact the outer surface of the rock ring 42 causing abrasion to further weaken the stability of the rock ring 42. Recesses 274 around the breaker surface of the drill bit 10 may provide a void to allow the broken portions of the rock ring 42 to flow from the bottom surface 22 of the well bore 20 to the major or minor junk slot 204A, 204B.

Figure 11:
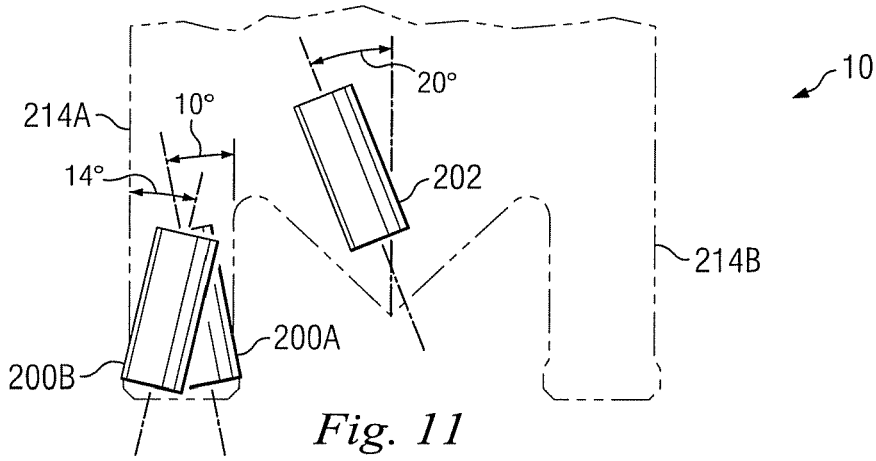
FIG. 11 is a schematic diagram of the orientation of the nozzles of a second embodiment of a drill bit.

Referring now to FIG. 11, an example orientation of the nozzles 200A, 200B, 202 are illustrated. The center nozzle 202 is disposed left of the center line of the drill bit 10 and angled on the order of around 20° left of vertical. Alternatively, both of the side nozzles 200A, 200B may be disposed on the same side arm 214 of the drill bit 10 as shown in FIG. 11. In this embodiment, the first side nozzle 200A, oriented to cut the inner portion of the exterior cavity 46, is angled on the order of around 10° left of vertical. The second side nozzle 200B is oriented at an angle on the order of around 14° right of vertical. This particular orientation of the nozzles allows for a large interior cavity 44 to be created by the center nozzle 202. The side nozzles 200A, 200B create a large enough exterior cavity 46 in order to allow the side arms 214A, 214B to fit in the exterior cavity 46 without incurring a substantial amount of resistance from uncut portions of the rock formation 270. By varying the orientation of the center nozzle 202, the interior cavity 44 may be substantially larger or smaller than the interior cavity 44 illustrated in FIG. 10. The side nozzles 200A, 200B may be varied in orientation in order to create a larger exterior cavity 46, thereby decreasing the size of the rock ring 42 and increasing the amount of mechanical cutting required to drill through the bottom surface 22 of the well bore 20. Alternatively, the side nozzles 200A, 200B may be oriented to decrease the amount of the inner wall 26 contacted by the solid material impactors 272. By orienting the side nozzles 200A, 200B at, for example, a vertical orientation, only a center portion of the exterior cavity 46 would be cut by the solid material impactors and the mechanical cutters would then be required to cut a large portion of the inner wall 26 of the well bore 20.

Figure 12:
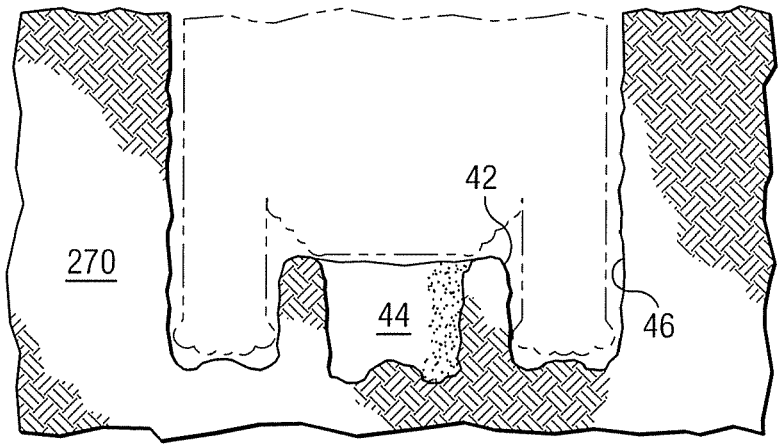
FIG. 12 is a side cross-sectional view of the rock formation created by the drill bit of FIG. 1 represented by the schematic of the drill bit of FIG. 1 inserted therein.
Figure 13:
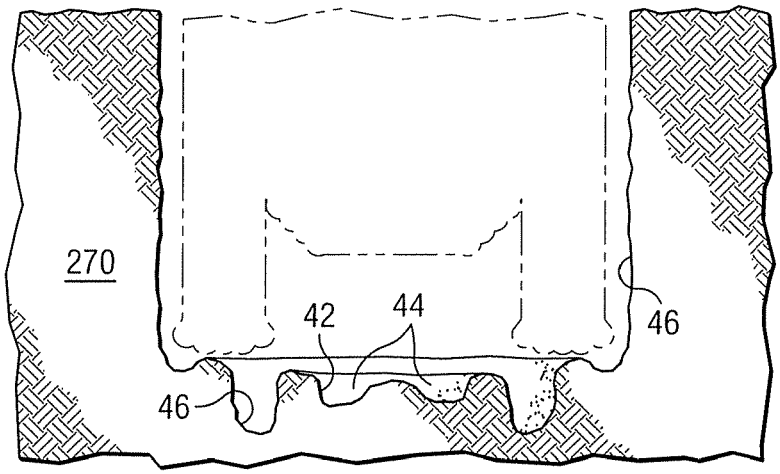
FIG. 13 is a side cross-sectional view of the rock formation created by drill bit of FIG. 1 represented by the schematic of the drill bit of FIG. 1 inserted therein.

Referring now to FIGS. 12 and 13, side cross-sectional views of the bottom surface 22 of the well bore 20 drilled by the drill bit 10 are shown. With the center nozzle angled on the order of around 20° left of vertical and the side nozzles 200A, 200B angled on the order of around 10° left of vertical and around 14° right of vertical, respectively, the rock ring 42 is formed. By increasing the angle of the side nozzle 200A, 200B orientation, an alternate rock ring 42 shape and bottom surface 22 is cut as shown in FIG. 13. The interior cavity 44 and rock ring 42 are much more shallow as compared with the rock ring 42 in FIG. 12. By differing the shape of the bottom surface 22 and rock ring 42, more stress is placed on the gauge bearing surfaces 206, mechanical cutters 208, and gauge cutters 230.

Although the drill bit 10 is described comprising orientations of nozzles and mechanical cutters, any orientation of either nozzles, mechanical cutters, or both may be utilized. The drill bit 10 need not comprise a center portion 203. The drill bit 10 also need not even create the rock ring 42. For example, the drill bit may only comprise a single nozzle and a single junk slot. Furthermore, although the description of the drill bit 10 describes types and orientations of mechanical cutters, the mechanical cutters may be formed of a variety of substances, and formed in a variety of shapes.

Figure 14:
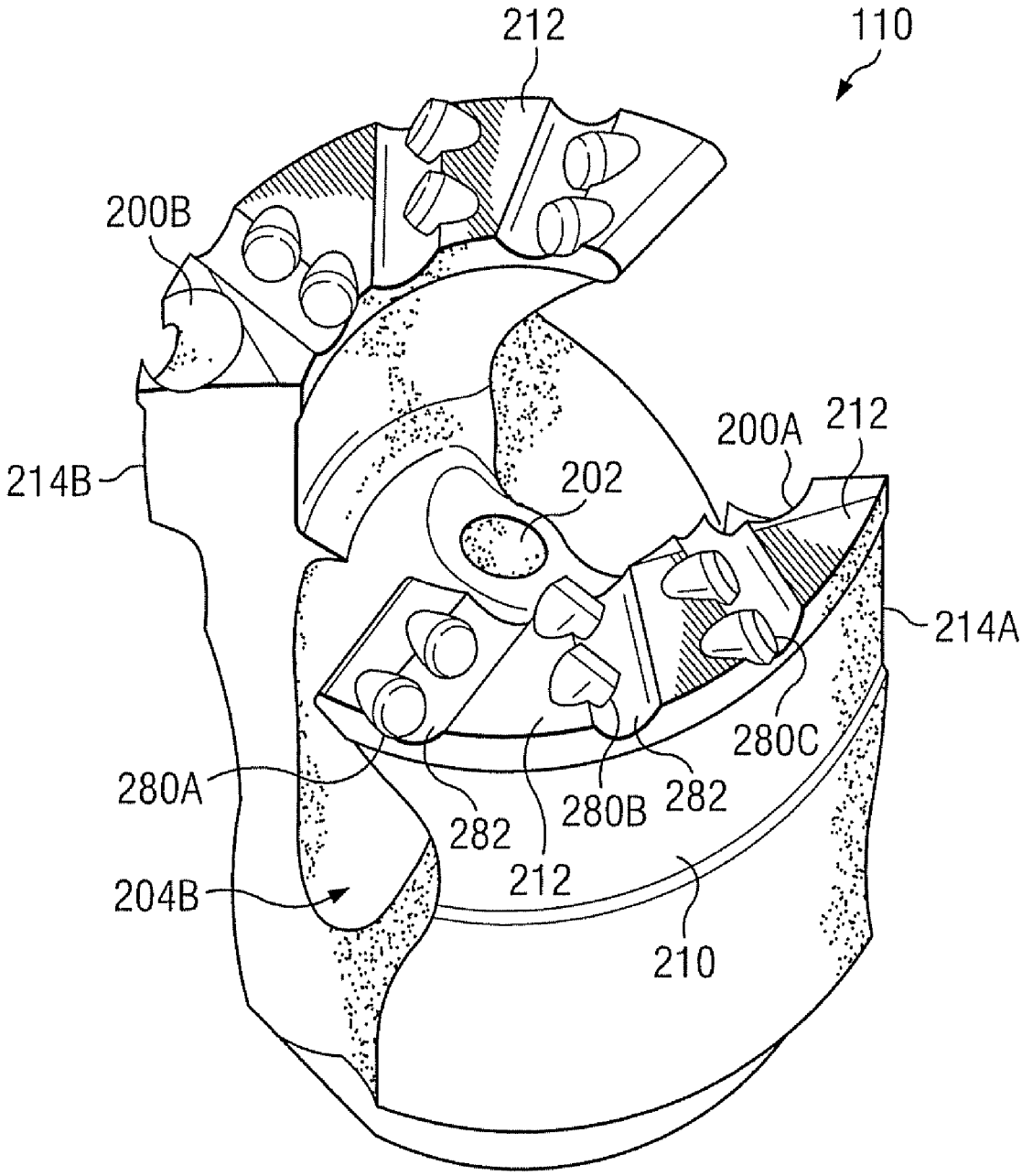
FIG. 14 is a perspective view of an alternate embodiment of a drill bit.
Figure 15:
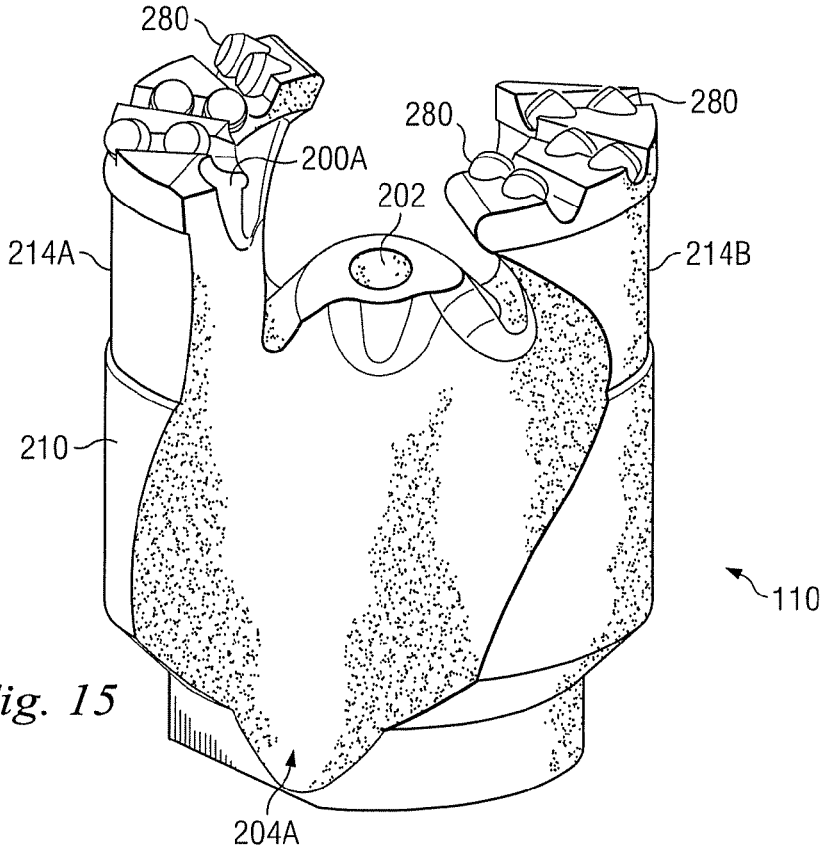
FIG. 15 is a perspective view of the drill bit of FIG. 14.
Figure 16:
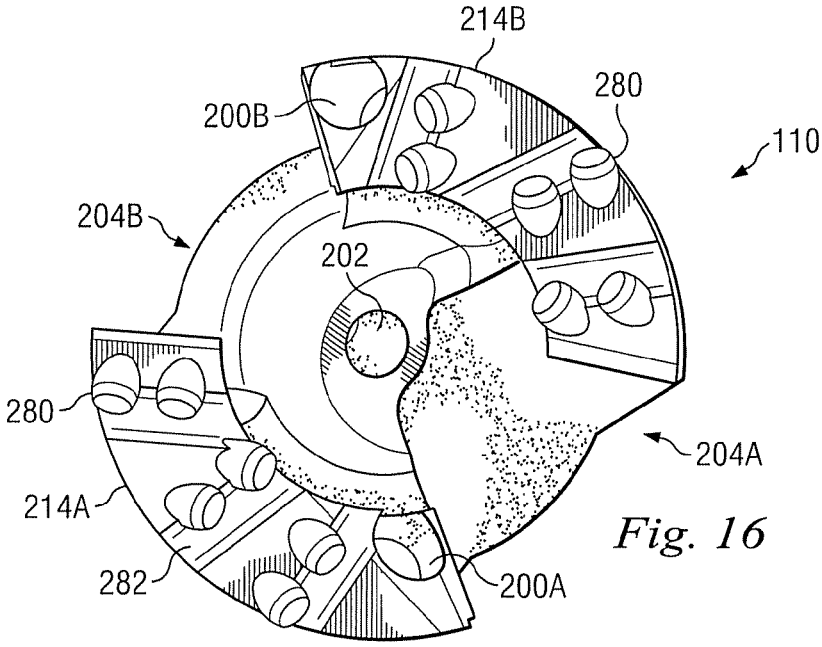
FIG. 16 illustrates an end elevational view of the drill bit of FIG. 14.

Referring now to FIGS. 14–16, a drill bit 110 in accordance with a second embodiment is illustrated. As previously noted, the mechanical cutters, such as the gauge cutters 230, mechanical cutters 208, and gauge bearing surfaces 206 may not be necessary in conjunction with the nozzles 200A, 200B, 202 in order to drill the required well bore 20. The side wall 210 of the drill bit 110 may or may not be interspersed with mechanical cutters. The side nozzles 200A, 200B and the center nozzle 202 are oriented in the same manner as in the drill bit 10, however, the face 212 of the side arms 214A, 214B comprises angled (PDCs) 280 as the mechanical cutters.

Still referring to FIGS. 14–16, each row of PDCs 280 is angled to cut a specific area of the bottom surface 22 of the well bore 20. A first row of PDCs 280A is oriented to cut the bottom surface 22 and also cut the inner wall 26 of the well bore 20 to the proper diameter. A groove 282 is disposed between the cutting faces of the PDCs 280 and the face 212 of the drill bit 110. The grooves 282 receive cuttings, drilling fluid 40, and solid material impactors and guide them toward the center nozzle 202 to flow through the major and minor junk slots 204A, 204B toward the surface. The grooves 282 may also guide some cuttings, drilling fluid 40, and solid material impactors toward the inner wall 26 to be received by the annulus 24 and also flow to the surface. Each subsequent row of PDCs 280B, 280C may be oriented in the same or different position than the first row of PDCs 280A. For example, the subsequent rows of PDCs 280B, 280C may be oriented to cut the exterior face of the rock ring 42 as opposed to the inner wall 26 of the well bore 20. The grooves 282 on one side arm 214A may also be oriented to guide the cuttings and drilling fluid 40 toward the center nozzle 202 and to the annulus 24 via the major junk slot 204A. The second side arm 214B may have grooves 282 oriented to guide the cuttings and drilling fluid 40 to the inner wall 26 of the well bore 20 and to the annulus 24 via the minor junk slot 204B.

With the drill bit 110, gauge cutters are not required. The PDCs 280 located on the face 212 of each side arm 214A, 214B are sufficient to cut the inner wall 26 to the correct size. However, mechanical cutters may be placed throughout the side wall 210 of the drill bit 10 to further enhance the stabilization and cutting ability of the drill bit 10.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A method of drilling a bore in a formation, the method comprising:

supplying solid material impactors to a drill bit comprising a longitudinal axis; and discharging the solid material impactors from the drill bit so that at least a portion of the solid material impactors contacts the formation, comprising:

discharging a first portion of the solid material impactors from the drill bit in a first direction, the first direction comprising:

a first directional component that is parallel to the longitudinal axis of the drill bit; and a second directional component extending from, and perpendicular to, the first directional component; and discharging a second portion of the solid material impactors from the drill bit in a second direction, the second direction comprising:

a third directional component that is parallel to the longitudinal axis of the drill bit; and a fourth directional component extending from, and perpendicular to, the third directional component.

2. A method of drilling a bore in a formation, the method comprising:

supplying solid material impactors to a drill bit comprising a longitudinal axis;

discharging the solid material impactors from the drill bit so that at least a portion of the solid material impactors contacts the formation, comprising:

discharging a first portion of the solid material impactors from the drill bit in a first direction, the first direction comprising:

a first directional component that is parallel to the longitudinal axis of the drill bit; and a second directional component extending from, and perpendicular to, the first directional component, wherein the second directional component is directed away from the longitudinal axis of the drill bit;

and discharging a second portion of the solid material impactors from the drill bit in a second direction, the second direction comprising:

a third directional component that is parallel to the longitudinal axis of the drill bit; and a fourth directional component extending from, and perpendicular to, the third directional component, wherein the fourth directional component is directed towards the longitudinal axis of the drill bit;

forming a rock ring within the bore in response to discharging the solid material impactors from the drill bit, comprising:

forming a generally radially-extending interior cavity in the bore, the interior cavity generally defining the inside diameter of the rock ring; and forming a generally circumferentially-extending exterior cavity in the bore, the exterior cavity being generally concentric with the interior cavity, the exterior cavity generally defining the outside diameter of the rock ring;

and fracturing the rock ring, comprising:

applying a side load on the rock ring;

wherein the drill bit comprises a junk slot; and wherein forming the interior cavity comprises causing at least a portion of the solid material impactors to contact the bottom surface of the bore and rebound into the junk slot.

3. A method of drilling a bore in a formation, the method comprising:

supplying drilling fluid and solid material impactors to a drill bit;

discharging the drilling fluid and the solid material impactors from the drill bit so that at least a portion of the solid material impactors contacts the formation; and forming a rock ring within the bore in response to discharging the drilling fluid and the solid material impactors from the drill bit.

4. A drill bit comprising a longitudinal center axis; a first nozzle oriented in a first direction, the first direction comprising a first directional component that is parallel to the longitudinal center axis, and a second directional component extending from, and generally perpendicular to, the first directional component; and a second nozzle oriented in a second direction, the second direction comprising a third directional component that is parallel to the longitudinal center axis, and a fourth directional component extending from, and generally perpendicular to, the third directional component.

5. A drill bit comprising a longitudinal center axis; a first nozzle oriented in a first direction, the first direction comprising a first directional component that is parallel to the longitudinal center axis, and a second directional component extending from, and generally perpendicular to, the first directional component; a second nozzle oriented in a second direction, the second direction comprising a third directional component that is parallel to the longitudinal center axis, and a fourth directional component extending from, and generally perpendicular to, the third directional component; first and second side arms, one of the first and second side arms comprising one of the first and second nozzles; and a center portion disposed between the first and second side arms; wherein each of the first and second nozzles is adapted to discharge drilling fluid and solid material impactors in a bore in a formation; wherein a rock ring is adapted to be at least partially formed within the bore in response to the discharge of the drilling fluid and the solid material impactors; wherein the center portion comprises a breaker surface adapted to break the rock ring; wherein the breaker surface comprises a conical surface adapted to apply a side load against the rock ring; wherein the center portion comprises the other of the first and second nozzles; wherein the conical surface tapers to the other of the first and second nozzles; and wherein each of the first and second side arms comprises a bottom face, a side wall extending from the bottom face, one or more mechanical cutters interspersed along the bottom face, and one or more grooves formed in the bottom face.

6. A system for drilling a bore in a formation, the system comprising:

means for supplying solid material impactors to a drill bit comprising a longitudinal axis and means for discharging the solid material impactors from the drill bit so that at least a portion of the solid material impactors contacts the formation, comprising:

means for discharging a first portion of the solid material impactors from the drill bit in a first direction, the first direction comprising:

a first directional component that is parallel to the longitudinal axis of the drill bit; and a second directional component extending from, and perpendicular to, the first directional component;

and means for discharging a second portion of the solid material impactors from the drill bit in a second direction, the second direction comprising:

a third directional component that is parallel to the longitudinal axis of the drill bit; and a fourth directional component extending from, and perpendicular to, the third directional component.

7. A system for drilling a bore in a formation, the system comprising:

means for supplying solid material impactors to a drill bit comprising a longitudinal axis;

means for discharging the solid material impactors from the drill bit so that at least a portion of the solid material impactors contacts the formation, comprising:

means for discharging a first portion of the solid material impactors from the drill bit in a first direction, the first direction comprising:

a first directional component that is parallel to the longitudinal axis of the drill bit; and a second directional component extending from, and perpendicular to, the first directional component, wherein the second directional component is directed away from the longitudinal axis of the drill bit;

and means for discharging a second portion of the solid material impactors from the drill bit in a second direction, the second direction comprising:

a third directional component that is parallel to the longitudinal axis of the drill bit; and a fourth directional component extending from, and perpendicular to, the third directional component, wherein the fourth directional component is directed towards the longitudinal axis of the drill bit;

means for forming a rock ring within the bore in response to discharging the solid material impactors from the drill bit, comprising:

means for forming a generally radially-extending interior cavity in the bore, the interior cavity generally defining the inside diameter of the rock ring; and means for forming a generally circumferentially-extending exterior cavity in the bore, the exterior cavity being generally concentric with the interior cavity, the exterior cavity generally defining the outside diameter of the rock ring;

and means for fracturing the rock ring, comprising:

means for applying a side load on the rock ring;

wherein the drill bit comprises a junk slot; and wherein means for forming the interior cavity comprises means for causing at least a portion of the solid material impactors to contact the bottom surface of the bore and rebound into the junk slot.

8. A system for drilling a bore in a formation, the system comprising:

means for supplying drilling fluid and solid material impactors to a drill bit;

means for discharging the drilling fluid and the solid material impactors from the drill bit so that at least a portion of the solid material impactors contacts the formation; and means for forming a rock ring within the bore in response to discharging the drilling fluid and the solid material impactors from the drill bit.

9. A method of drilling a bore in a formation, the method comprising:

supplying drilling fluid and solid material impactors to a drill bit comprising a longitudinal axis, comprising coupling a drill string to the drill bit, the drill string comprising a passage through which the drilling fluid is supplied to the drill bit, wherein an annulus is defined between the drill string and the inner wall of the bore;

discharging the drilling fluid and the solid material impactors from the drill bit so that at least a portion of the solid material impactors contacts the formation, wherein formation cuttings are formed in response to discharging the drilling fluid and the solid material impactors from the drill bit, wherein discharging the drilling fluid and the solid material impactors from the drill bit comprises:

discharging a first portion of the solid material impactors from the drill bit in a first direction, the first direction comprising:

a first directional component that is parallel to the longitudinal axis of the drill bit; and a second directional component extending from, and perpendicular to, the first directional component, wherein the second directional component is directed away from the longitudinal axis of the drill bit;

and discharging a second portion of the solid material impactors from the drill bit in a second direction, the second direction comprising:

a third directional component that is parallel to the longitudinal axis of the drill bit; and a fourth directional component extending from, and perpendicular to, the third directional component, wherein the fourth directional component is directed towards the longitudinal axis of the drill bit;

forming a rock ring within the bore, comprising:

at least one of:

discharging the first portion of the solid material impactors from the drill bit in the first direction; and discharging the second portion of the solid material impactors from the drill bit in the second direction;

forming a generally radially-extending interior cavity in the bore, the interior cavity generally defining the inside diameter of the rock ring; and forming a generally circumferentially-extending exterior cavity in the bore, the exterior cavity being generally concentric with the interior cavity, the exterior cavity generally defining the outside diameter of the rock ring; fracturing the rock ring, comprising:

applying a side load on the rock ring;

breaking down large portions of the rock ring; and abrading and delivering load to the rock ring; circulating at least a portion of the solid material impactors through the annulus;

abrading the bottom surface of the bore;

forming the final diameter of the bore, comprising at least one of:

trimming the bore; and refining the inner wall of the bore;

stabilizing and reducing vibration in the drill bit; and permitting the drilling fluid, at least a portion of the cuttings, and at least a portion of the solid material impactors to flow freely from the bottom surface of the bore and to the annulus;

wherein the drill bit comprises first and second junk slots;

wherein forming the interior cavity comprises:

causing at least a portion of the solid material impactors to contact the bottom surface of the bore and rebound into the first junk slot; and causing at least another portion of the solid material impactors to contact the bottom surface of the bore and rebound into the first junk slot; wherein forming the exterior cavity further comprises:

causing at least a portion of the solid material impactors to contact the bottom surface of the bore and rebound into the second junk slot;

wherein the exterior cavity comprises generally circumferentially-extending inner and outer portions, the inner and outer portions being generally concentric;

wherein forming the exterior cavity comprises:

cutting the formation at the outer portion of the exterior cavity; and cutting the formation at the inner portion of the exterior cavity;

wherein residual pieces of the rock ring are formed in response to fracturing the rock ring;

wherein the method further comprises washing at least a portion of the residual pieces of the rock ring away from the drill bit through the annulus;

wherein broken portions of the rock ring are formed in response to fracturing the rock ring;

wherein the method further comprises:

permitting the broken portions of the rock ring to flow from the bottom surface of the bore to the first and second junk slots; and guiding the cuttings and the drilling fluid to the annulus via the first and second junk slots;

wherein the drill bit comprises first, second and third nozzles; and wherein discharging the drilling fluid and the solid material impactors from the drill bit comprises:

feeding at least a portion of the drilling fluid and at least a portion of the solid material impactors to the first nozzle;

feeding at least a portion of the drilling fluid and at least a portion of the solid material impactors to the second nozzle; and feeding at least a portion of the drilling fluid and at least a portion of the solid material impactors to the third nozzle.

10. A drill bit adapted to discharge drilling fluid and solid material impactors in a bore in a formation, the drill bit comprising:

a longitudinal center axis;

a first nozzle oriented in a first direction, the first direction comprising:

a first directional component that is parallel to the longitudinal center axis, and a second directional component extending from, and generally perpendicular to, the first directional component, wherein the second directional component is directed away from the longitudinal center axis; and a second nozzle oriented in a second direction, the second direction comprising:

a third directional component that is parallel to the longitudinal center axis, and a fourth directional component extending from, and generally perpendicular to, the third directional component, wherein the fourth directional component is directed towards the longitudinal center axis;

a third nozzle adapted to discharge a third portion of the solid material impactors in the bore;

first, second and third cavities fluidicly coupled to the first, second and third nozzles, respectively, wherein the cavities are adapted to be fluidicly coupled to a common plenum;

first and second side arms, each of the first and second side arms comprising a radially interior portion and a radially exterior portion, the first side arm comprising the third nozzle and one of the first and second nozzles a center portion disposed between the first and second side arms, the center portion comprising the other of the first and second nozzles;

a first junk slot extending between the first and second arms; and a second junk slot extending between the first and second arms;

wherein the center portion is disposed between the first and second junk slots;

wherein a rock ring is adapted to be at least partially formed within the bore in response to the discharge of the drilling fluid and the solid material impactors;

wherein the center portion comprises a breaker surface adapted to break the rock ring;

wherein the breaker surface comprises a conical surface adapted to apply a side load against the rock ring;

wherein the conical surface tapers to the other of the first and second nozzles;

wherein the breaker surface comprises one or more mechanical cutters adapted to abrade and load the rock ring;

wherein the second direction is configured so that at least a portion of the solid material impactors adapted to be discharged from the second nozzle are adapted to contact the formation and rebound into the first junk slot;

wherein the first direction is configured so that at least a portion of the solid material impactors adapted to be discharged from the first nozzle are adapted to contact the formation and rebound into the second junk slot;

wherein the breaker surface comprises one or more recesses adapted to permit broken portions of the rock ring to flow from the bottom surface of the bore to the first junk slot; and wherein each of the first and second side arms comprises:

a bottom face;

a side wall extending from the bottom face;

one or more mechanical cutters interspersed along the bottom face and adapted to break down large portions of the rock ring and abrade the bottom surface of the bore;

one or more grooves formed in the bottom face;

one or more other mechanical cutters interspersed along the side wall, wherein the one or more other mechanical cutters comprise one or more gauge cutters adapted to form the final diameter of the bore, and wherein at least one of the gauge cutters comprises a cutting face adapted to contact the inner wall of the bore; and one or more gauge bearing surfaces interspersed along the side wall and adapted to reduce vibration generated during the discharge of the drilling fluid and the solid material impactors.

11. A system for drilling a bore in a formation, the system comprising:

means for supplying drilling fluid and solid material impactors to a drill bit comprising a longitudinal axis, comprising means for coupling a drill string to the drill bit, the drill string comprising a passage through which the drilling fluid is supplied to the drill bit, wherein an annulus is defined between the drill string and the inner wall of the bore;

means for discharging the drilling fluid and the solid material impactors from the drill bit so that at least a portion of the solid material impactors contacts the formation, wherein formation cuttings are formed in response to discharging the drilling fluid and the solid material impactors from the drill bit, wherein means for discharging the drilling fluid and the solid material impactors from the drill bit comprises:

means for discharging a first portion of the solid material impactors from the drill bit in a first direction, the first direction comprising:

a first directional component that is parallel to the longitudinal axis of the drill bit; and a second directional component extending from, and perpendicular to, the first directional component, wherein the second directional component is directed away from the longitudinal axis of the drill bit;

and means for discharging a second portion of the solid material impactors from the drill bit in a second direction, the second direction comprising:

a third directional component that is parallel to the longitudinal axis of the drill bit; and a fourth directional component extending from, and perpendicular to, the third directional component, wherein the fourth directional component is directed towards the longitudinal axis of the drill bit;

means for forming a rock ring within the bore, comprising:

at least one of:

means for discharging the first portion of the solid material impactors from the drill bit in the first direction; and means for discharging the second portion of the solid material impactors from the drill bit in the second direction;

means for forming a generally radially-extending interior cavity in the bore, the interior cavity generally defining the inside diameter of the rock ring; and means for forming a generally circumferentially-extending exterior cavity in the bore, the exterior cavity being generally concentric with the interior cavity, the exterior cavity generally defining the outside diameter of the rock ring;

means for fracturing the rock ring, comprising:

means for applying a side load on the rock ring;

means for breaking down large portions of the rock ring; and means for abrading and delivering load to the rock ring;

means for circulating at least a portion of the solid material impactors through the annulus;

means for abrading the bottom surface of the bore;

means for forming the final diameter of the bore, comprising at least one of:

means for trimming the bore; and means for refining the inner wall of the bore;

means for stabilizing and reducing vibration in the drill bit; and means for permitting the drilling fluid, at least a portion of the cuttings, and at least a portion of the solid material impactors to flow freely from the bottom surface of the bore and to the annulus;

wherein the drill bit comprises first and second junk slots;

wherein means for forming the interior cavity comprises:

means for causing at least a portion of the solid material impactors to contact the bottom surface of the bore and rebound into the first junk slot; and means for causing at least another portion of the solid material impactors to contact the bottom surface of the bore and rebound into the first junk slot; wherein means for forming the exterior cavity further comprises:

means for causing at least a portion of the solid material impactors to contact the bottom surface of the bore and rebound into the second junk slot;

wherein the exterior cavity comprises generally circumferentially-extending inner and outer portions, the inner and outer portions being generally concentric;

wherein means for forming the exterior cavity comprises:

means for cutting the formation at the outer portion of the exterior cavity; and means for cutting the formation at the inner portion of the exterior cavity;

wherein residual pieces of the rock ring are formed in response to fracturing the rock ring;

wherein the system further comprises means for washing at least a portion of the residual pieces of the rock ring away from the drill bit through the annulus;

wherein broken portions of the rock ring are formed in response to fracturing the rock ring;

wherein the system further comprises:

means for permitting the broken portions of the rock ring to flow from the bottom surface of the bore to the first and second junk slots; and means for guiding the cuttings and the drilling fluid to the annulus via the first and second junk slots;

wherein the drill bit comprises first, second and third nozzles; and wherein means for discharging the drilling fluid and the solid material impactors from the drill bit comprises:

means for feeding at least a portion of the drilling fluid and at least a portion of the solid material impactors to the first nozzle;

means for feeding at least a portion of the drilling fluid and at least a portion of the solid material impactors to the second nozzle; and means for feeding at least a portion of the drilling fluid and at least a portion of the solid material impactors to the third nozzle.

* * * * *